US009323189B2

(12) United States Patent
Iwata et al.

(10) Patent No.: US 9,323,189 B2
(45) Date of Patent: Apr. 26, 2016

(54) HEATING ELEMENTS FOR MAINTAINING TEMPERATURE OF A FIXING FILM IN A FIXING DEVICE AND IMAGE FORMING APPARATUS

(71) Applicant: Brother Kogyo Kabushiki Kaisha, Nagoya-shi, Aichi-ken (JP)

(72) Inventors: Naoyuki Iwata, Kagamihara (JP); Tomoaki Hazeyama, Yokkaichi (JP); Yasuhiro Maruyama, Kasugai (JP); Akihiro Kobayashi, Yokkaichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/668,484

(22) Filed: Mar. 25, 2015

(65) Prior Publication Data

US 2015/0277311 A1 Oct. 1, 2015

(30) Foreign Application Priority Data

Mar. 28, 2014 (JP) ..... 2014-070065

(51) Int. Cl.
*G03G 15/20* (2006.01)

(52) U.S. Cl.
CPC .... *G03G 15/2042* (2013.01); *G03G 2215/2035* (2013.01)

(58) Field of Classification Search
CPC ..... G03G 15/2042
USPC ..... 399/329
See application file for complete search history.

(56) References Cited

U.S. PATENT DOCUMENTS 7,130,572 B2 10/2006 Kubochi et al.
2005/0220509 A1 10/2005 Kubochi et al.

FOREIGN PATENT DOCUMENTS

JP 2005-292335 A 10/2005
JP 2007-328158 A 12/2007
JP 2007328158 A * 12/2007
JP 4280664 B2 6/2009

OTHER PUBLICATIONS

Computer translation of JP2007-328158A; filed Dec. 20, 2007 to Ito et al.*

* cited by examiner

*Primary Examiner* — Quana M Grainger
(74) *Attorney, Agent, or Firm* — Banner & Witcoff, Ltd.

(57) ABSTRACT

A fixing device includes an endless belt extending in a first direction and configured to rotate, a nip member extending in the first direction and disposed in contact with an inner surface of the endless belt, a backup member extending in the first direction and disposed in contact with an outer surface of the endless belt such that that the backup roller and the nip member sandwich the endless belt therebetween and the backup member and the endless belt form a nip therebetween, a first heating element extending along the endless belt in the first direction and configured to generate heat, and an inner surface guide disposed in contact with an end portion of the inner surface of the endless belt in the first direction and spaced apart from the nip in a second direction. The inner surface guide includes a second heating element configured to generate heat.

17 Claims, 7 Drawing Sheets

HEATING ELEMENTS FOR MAINTAINING TEMPERATURE OF A FIXING FILM IN A FIXING DEVICE AND IMAGE FORMING APPARATUS

CROSS REFERENCE TO RELATED APPLICATION

This application claims priority from Japanese Patent Application No. 2014-070065, filed on Mar. 28, 2014, which is incorporated herein by reference in its entirety.

TECHNICAL FIELD

Aspects of the disclosure relate to a fixing device configured to fix a developer image onto a recording sheet and an image forming apparatus including such a fixing device.

BACKGROUND

A known fixing device includes a tubular fixing film, guide members guiding respective end portions of the fixing film, a ceramic heater disposed inside the fixing film, and a pressure roller disposed facing the fixing belt such that the pressure roller and the ceramic heater hold the fixing belt therebetween.

SUMMARY

In the known fixing device, however, as the end portions of the fixing film contact the respective guide members, heat at the end portions of the fixing film is lost by the guide members, and thus there is a problem that the temperature at the end portions of the fixing film is less likely to rise than that at a central portion thereof.

Illustrative aspects of the disclosure provide a fixing device configured to maintain the temperature at both end portions of a fixing film (or an endless belt) appropriately and an image forming apparatus including the fixing device.

According to an aspect of the disclosure, a fixing device includes an endless belt extending in a first direction and configured to rotate, a nip member extending in the first direction and disposed in contact with an inner surface of the endless belt, a backup member extending in the first direction and disposed in contact with an outer surface of the endless belt such that that the backup roller and the nip member sandwich the endless belt therebetween and the backup member and the endless belt form a nip therebetween, a first heating element extending along the endless belt in the first direction and configured to generate heat, and an inner surface guide disposed in contact with an end portion of the inner surface of the endless belt in the first direction and spaced apart from the nip in a second direction perpendicular to the first direction. The inner surface guide includes a second heating element configured to generate heat.

With this structure, the end portion of the endless belt, at which the temperature is less likely to rise by the application of heat from the first heating element, can be heated by the second heating element while being guided by the inner surface guide. Thus, the temperatures at the end portion of the endless belt can be maintained appropriately.

According to another aspect of the disclosure, an image forming apparatus includes a controller and a fixing device. The fixing device includes an endless belt extending in a first direction and configured to rotate, a nip member extending in the first direction and disposed in contact with an inner surface of the endless belt, a backup member extending in the first direction and disposed in contact with an outer surface of the endless belt such that that the backup roller and the nip member sandwich the endless belt therebetween and the backup member and the endless belt form a nip therebetween, a first heating element extending along the endless belt in the first direction and configured to generate heat, and an inner surface guide disposed in contact with an end portion of the inner surface of the endless belt in the first direction and spaced apart from the nip in a second direction perpendicular to the first direction. The inner surface guide includes a second heating element configured to generate heat. The controller is configured to set the second heating element to an off state for thermally fixing a sheet having a minimum width on which the fixing device is configured to form an image.

This prevents the end portion of the endless belt that does not contact a sheet from being heated by the second heating element uselessly when an image on the sheet having the minimum width is thermally fixed. Thus, the end portion of the endless belt can be prevented from overheating.

According to another aspect of the disclosure, an image forming apparatus includes a controller and a fixing device. The fixing device includes an endless belt extending in a first direction and configured to rotate, a nip member extending in the first direction and disposed in contact with an inner surface of the endless belt, a backup member extending in the first direction and disposed in contact with an outer surface of the endless belt such that that the backup roller and the nip member sandwich the endless belt therebetween and the backup member and the endless belt form a nip therebetween, a first heating element extending along the endless belt in the first direction and configured to generate heat, and an inner surface guide disposed in contact with an end portion of the inner surface of the endless belt in the first direction and spaced apart from the nip in a second direction perpendicular to the first direction. The inner surface guide includes a second heating element configured to generate heat. The controller is configured to set the second heating element to an on sate during warm up prior to printing control.

When the printing control is performed, the end portion of the endless belt can become heated to an appropriate high temperature at the printing control.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An embodiment of the disclosure will be described with reference to the following drawings. In the following description, the expressions "front", "rear", "upper or top", "lower or bottom", "right", and "left" are used to define the various parts when a color laser printer 1 is disposed in an orientation in which it is intended to be used.

Figure 1:
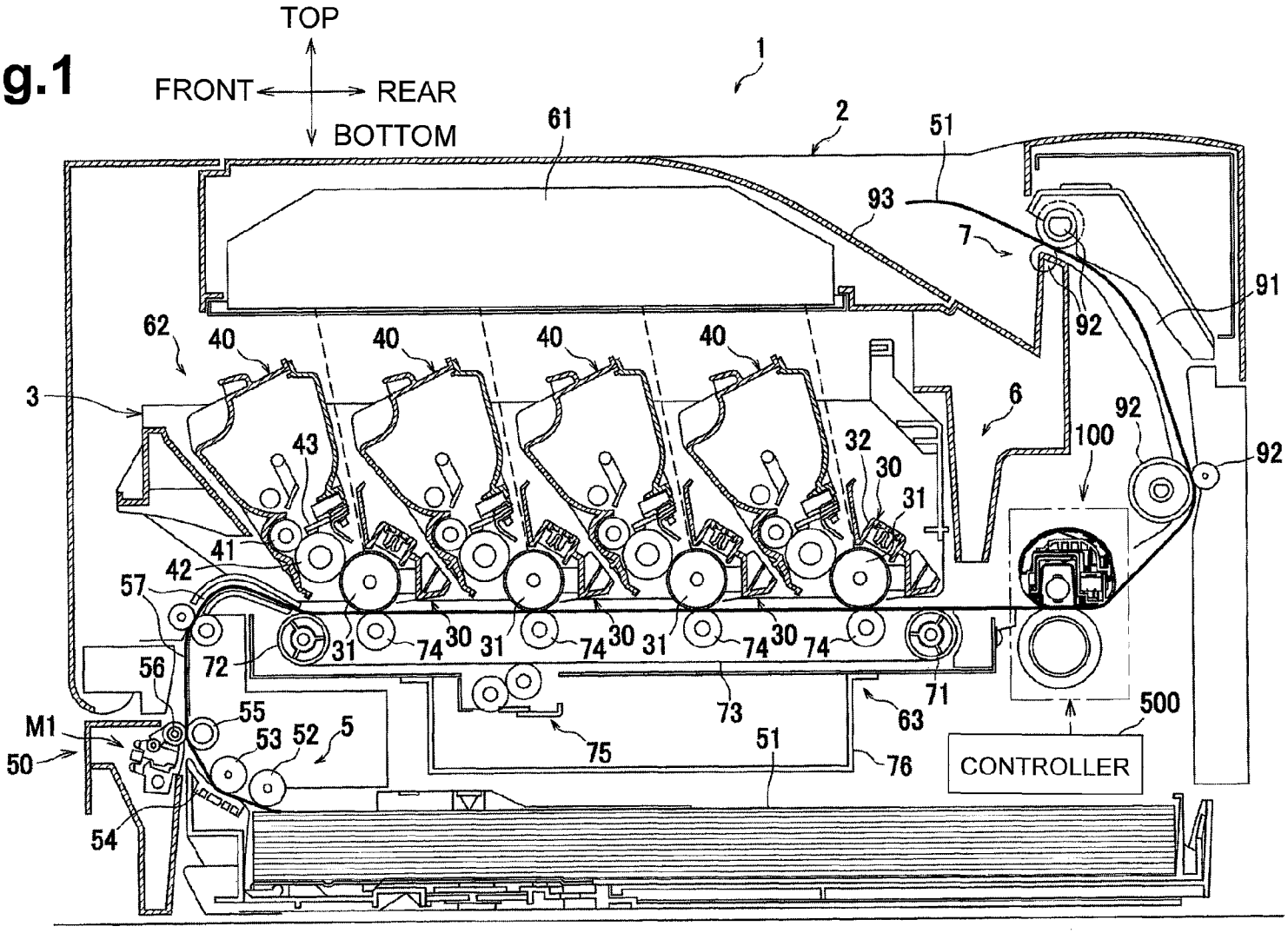
FIG. 1 is a sectional view of a color laser printer including a fixing device according to an illustrative embodiment.

As illustrated in FIG. 1, the color laser printer 1 includes, in a housing 2, a sheet feed portion 5 configured to feed a recording sheet, e.g., a sheet 51, an image forming unit 6 configured to form an image on the sheet 51 fed by the sheet feed portion 5, an ejection portion 7 configured to eject the sheet 51 having the image formed thereon, and a controller 500. The sheet 51 may be a piece of cardboard, a postcard, thin paper, or a transparency.

The sheet feed portion 5 includes a sheet supply tray 50 disposed in a lower portion of the housing 2 and a sheet feed mechanism M1. The sheet supply tray 50 is configured to be slidably attached to and removed from the housing 2 from a front side thereof. The sheet feed mechanism M1 is configured to feed a sheet 51 from the sheet supply tray 50 by raising it from the front side and then reversing it rearward.

The sheet feed mechanism M1 includes a pickup roller 52, a separation roller 53, and a separation pad 54, which are disposed proximate to a front end portion of the sheet supply tray 50 and are configured to feed sheets 51 one by one upward from the sheet supply tray 50. A sheet 51 being fed upward passes through between a dust removing roller 55 and a pinch roller 56 into a sheet feed passage 57, and the sheet 51 is directed rearward and supplied onto a conveyor belt 73, which will be described later. When the sheet 51 passes through between the dust removing roller 55 and the pinch roller 56, dust adhering to the sheet 51 is removed by the dust removing roller 55.

The image forming portion 6 includes a scanner portion 61, a process portion 62, a transfer portion 63, and a fixing device 100.

The scanner portion 61 is disposed in an upper portion of the housing 2, and includes laser emitting portions corresponding to cyan, magenta, yellow, and black, respectively, a polygon mirror, lenses and reflective mirrors, which are not illustrated. In the scanner unit 61, laser beams emitted from the respective laser emitting portions are directed to the polygon mirror rotating at high speed. The laser beams then pass through or are reflected by the lenses and the reflective mirrors, and scan surfaces of the respective photosensitive drums 31 in a left-right direction.

The process portion 62 is disposed below the scanner portion 61 and above the sheet feed portion 5, and includes a photosensitive member unit 3 configured to move in the front-rear direction relative to the housing 2. The photosensitive member unit 3 includes a plurality of, e.g., four, drum sub units 30, and a plurality of, e.g., four, developing cartridges 40 each detachably attached to a corresponding one of the drum sub units 30.

Each drum sub unit 30 includes a photosensitive drum 31 and a scorotron charger 32, which are known.

Each developing cartridge 40 contains toner, as an example of a developer, inside, and includes a supply roller 41, a developing roller 42, and a layer-thickness regulating blade 43, which are known.

The process portion 62 functions as follows. Toner contained in each developing cartridge 40 is supplied to the developing roller 42 by rotation of the supply roller 41 and positively charged between the supply roller 41 and the developing roller 42 by friction. The toner supplied to the rotating developing roller 42 is scraped by the layer-thickness regulating blade 43 and carried on a surface of the developing roller 42 as a thin layer having a constant thickness.

In each drum sub unit 30, the scorotron charger 32 charges the photosensitive drum 31 uniformly and positively by corona discharge. The charged photosensitive drum 31 is irradiated by the laser light emitted from the scanner portion 61 so that an electrostatic latent image corresponding to an image to be formed on a sheet 51 is formed on the photosensitive drum 31.

When the photosensitive drum 31 further rotates, the toner carried on the developing roller 42 is supplied to the electrostatic latent image formed on the photosensitive drum 31, that is, exposed areas having low potential on the surface of the photosensitive drum 31. Thus, the electrostatic latent image becomes visible, and a toner image corresponding to each color toner is carried on the surface of the photosensitive drum 31.

The transfer unit 63 includes a drive roller 71, a driven roller 72, a conveyor belt 73, a plurality of transfer rollers 74 and a cleaning unit 75.

The drive roller 71 and the driven roller 72 are spaced apart parallel to each other in the front-rear direction. The conveyor belt 73, which is endless, is looped under tension around the drive roller 71 and the driven roller 72. An outer surface of the conveyor belt 73 contacts the photosensitive drums 31. The transfer rollers 74 are disposed within a loop of the conveyor belt 73 such that the transfer rollers 74 faces the respective photosensitive drums 31 via the conveyor belt 73. The transfer rollers 74 and the respective photosensitive drums 31 sandwich the conveyor belt 73 therebetween. The transfer rollers 74 each receive a transfer bias applied from a high-voltage board, not shown. During image formation, a sheet 51 conveyed by the conveyor belt 73 receives toner images on the respective photosensitive drums 31.

The cleaning unit 75 is disposed below the conveyor belt 73 and configured to remove waste toner adhered on the conveyor belt 73 and drop the removed waste toner to a waste toner storing portion 76 disposed below the cleaning unit 75.

The fixing device 100 is disposed behind the transfer unit 63 and configured to thermally fix the toner images transferred onto the sheet 51.

In the ejection portion 7, a sheet ejection path 91 extends upward to the front side from an outlet of the fixing device 100. A plurality of feed rollers 92 to feed the sheet 51 is disposed in the middle of the sheet ejection path 91. An upper surface of the housing 2 contains an ejection tray 93 to receive sheets 51 having images. Sheets 51 ejected from the sheet ejection path 91 by the feed rollers 92 are accumulated on the ejection tray 93.

The fixing device 100 will be described in detail.

Figure 2:
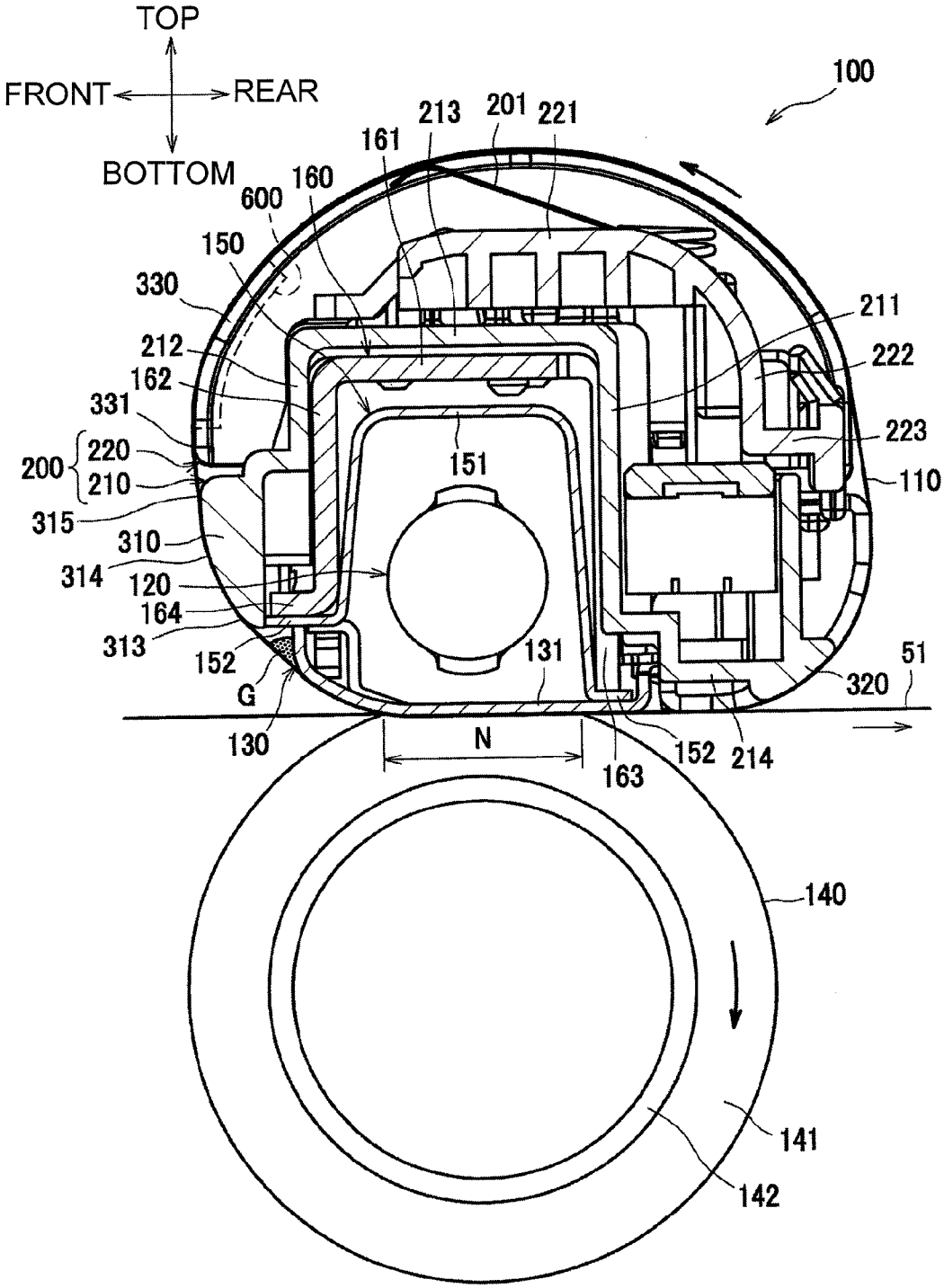
FIG. 2 is a sectional view of the fixing device.

As illustrated in FIG. 2, the fixing device 100 includes a fixing belt 110 as an example of an endless belt, a halogen lamp 120 as an example of a first heating element, a nip plate 130 as an example of a nip member, a pressure roller 140 as an example of a backup member, a reflective plate 150, a stay 160, and a covering member 200 made of resin.

The fixing belt 110 is an endless (or tubular) belt having heat resistance and flexibility, and its rotation is guided by guide portions formed in the covering member 200 (an upstream guide 310, a downstream guide 320, and end portion guides 330). Specifically, in the embodiment, the fixing belt 110 is a metal belt having a metal-made base member coated with resin.

Alternatively, the fixing belt 110 may have a rubber layer on the metal surface and may further have a non-metal protective layer, e.g. a fluorine coated layer, on the rubber layer.

The fixing belt 110 is urged outwardly in a radial direction with a slightly weak urging force by a wire spring 201 disposed in the covering member 200. This allows the fixing belt 110 to be tensed by the wire spring 200 and move outward in the radial direction.

A member applying tension to the fixing belt 110 is not limited to the wire spring 201. Instead, a plate spring may be used. Alternatively, the wire spring 201 may be omitted as long as the fixing belt 110 may be movable outward in the radial direction.

The halogen lamp 120 is a heater to configured to heat toner on a sheet 51 by applying radiant heat to heat (a nip portion N between) the nip plate 130 and the fixing belt 110. The halogen lamp 120 extends in the left-right direction inside the fixing belt 110 and is disposed at a specified distance from the fixing belt 110 and an inner surface of the nip plate 130.

The nip plate 130 is shaped like a plate receiving the radiant heat from the halogen lamp 120 and is disposed inside the fixing belt 110 such that its lower surface contacts an inner cylindrical surface of the fixing belt 110. In the embodiment, the nip plate 130 is made of metal and formed by bending a material, e.g., an aluminum plate, having higher thermal conductivity than the steel stay 160. The nip plate 130 made of aluminum can improve its thermal conductivity.

Figure 3:
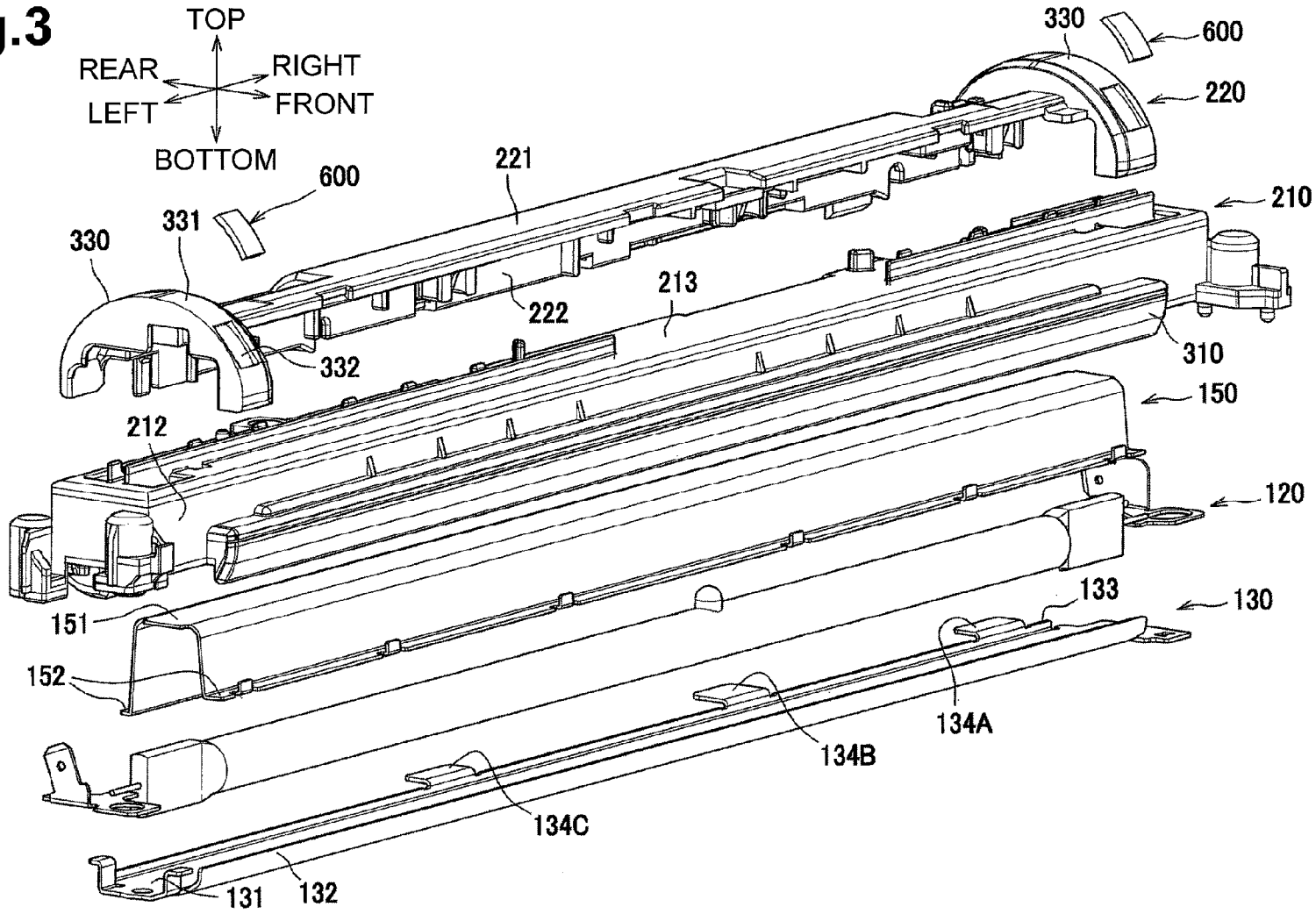
FIG. 3 is an exploded perspective view of the fixing device including a nip plate.

As illustrated in FIGS. 2 and 3, the nip plate 130 includes a plate-shaped portion 131, a front-side bent portion 132, a rear-side bent portion 133, and three detected portions 134A, 134B, 134C.

The plate-shaped portion 131 extends long in the left-right direction. A inner surface (or an upper surface) of the plate-shaped portion 131 may be coated with black paint or provided with a heat absorbing member to efficiently absorb the radiant heat from the halogen lamp 120.

The front-side bent portion 132 is bent, in substantially an arc shape, upward from a front end of the plate-shaped portion 131. Specifically, the front-side bent portion 132 is bent toward a flange 164 of the stay 160, and an upper end of the front-side bent portion 132 is supported by a flange 152 of the reflective plate 150 and the flange 164 of the stay 160.

The rear-side bent portion 133 extends upward from a rear end of the plate-shaped portion 131.

The three detected portions 134A, 134B, 134C are portions at which temperature of the nip plate 130 is detected by a thermistor or a thermostat, not illustrated, and each extend rearward from a part of an upper end of the rear-side bent portion 133.

The pressure roller 140 is disposed below the nip plate 130 such that the pressure roller 140 and the nip plate 130 sandwich the fixing belt 110 therebetween to form a nip N between the fixing belt 110 and the pressure roller 140. In the embodiment, one of the nip plate 130 and the pressure roller 140 is urged toward the other one thereof to form the nip N. The pressure roller 140 is configured to rotate along with the fixing belt 110 sandwiched between the pressure roller 140 and the nip plate 130 and to feed a sheet 51 rearward.

The pressure roller 140 includes a tubular roller main body 141 and a shaft 142 inserted into the roller main body 141 and rotatable along with the roller main body 141. The roller main body 141 is deformable. The pressure roller 140 is configured to rotate upon receipt of a driving force transmitted from a motor (not illustrated) disposed in the housing 2. The rotation of the pressure roller 140 allows the fixing belt 110 to be rotated due to friction between the pressure roller 140 and the fixing belt 110 (or a sheet 51 on the fixing belt 110). The sheet 51 on which a toner image has been transferred is fed to (the nip N) between the pressure roller 140 and the heated fixing belt 110, and thus the toner image is thermally fixed onto the sheet 51.

The reflective plate 150 is configured to reflect the radiant heat from the halogen lamp 120 toward the nip plate 130 and is disposed surrounding the halogen lamp 120 at a specified distance from the halogen lamp 120 inside the fixing belt 110.

The reflective plate 150 is formed by bending, in a substantially U-shape in cross section, a material, e.g., an aluminum plate, having high infrared and far-infrared reflectance and high thermal conductivity. Specifically, the reflective plate 150 includes a reflective portion 151 having a curved shape, e.g., a substantially U-shape in cross section, and flanges 152 each extending outward in the front-rear direction from a corresponding lower end of the reflective portion 151.

Each flange 152 is sandwiched between the stay 160 and the nip plate 130.

The stay 160 is configured to support the nip plate 130 via the reflective plate 150 to receive a force exerted from the pressure roller 140. The stay 160 is disposed surrounding the halogen lamp 120 and the reflective plate 150 inside the fixing belt 110. Note that the force refers to a reaction force against a force with which the nip plate 130 urges the pressure roller 140.

Specifically, the stay 160 includes an upper wall 161, a front wall 162 extending downward from a front end of the upper wall 161, and a rear wall 163 extending downward from a rear end of the upper wall 161, such that it is shaped like a letter U in cross-sectional view. The flange 164 extends frontward from a lower end portion of the front wall 162, The stay 160 is formed by bending a metal plate, e.g., a steel plate, having relatively high stiffness.

The covering member 200 mainly includes a first covering member 210 made of resin and a second covering member 220 made of resin.

The first covering member 210 is U-shaped in cross section and extends long in the left-right direction. The first covering member 210 is disposed covering the stay 160 on a side of the stay 160 opposite to the halogen lamp 120. In other words, the first covering member 210 is disposed opposite to the nip plate 130 relative to the stay 160.

The first covering member 210 mainly includes a rear wall 211, a front wall 212, an upper wall 213 connecting upper ends of the rear wall 211 and the front wall 212, and an extension wall 214 extending rearward from a lower end of the rear wall 211.

A lower end portion of the front wall 212 is integrally formed with an upstream guide 310 configured to guide a lower front portion of the fixing belt 110. A rear end of the extension wall 214 is integrally formed with a downstream guide 320 configured to guide a lower rear portion of the fixing belt 110.

Figure 4:
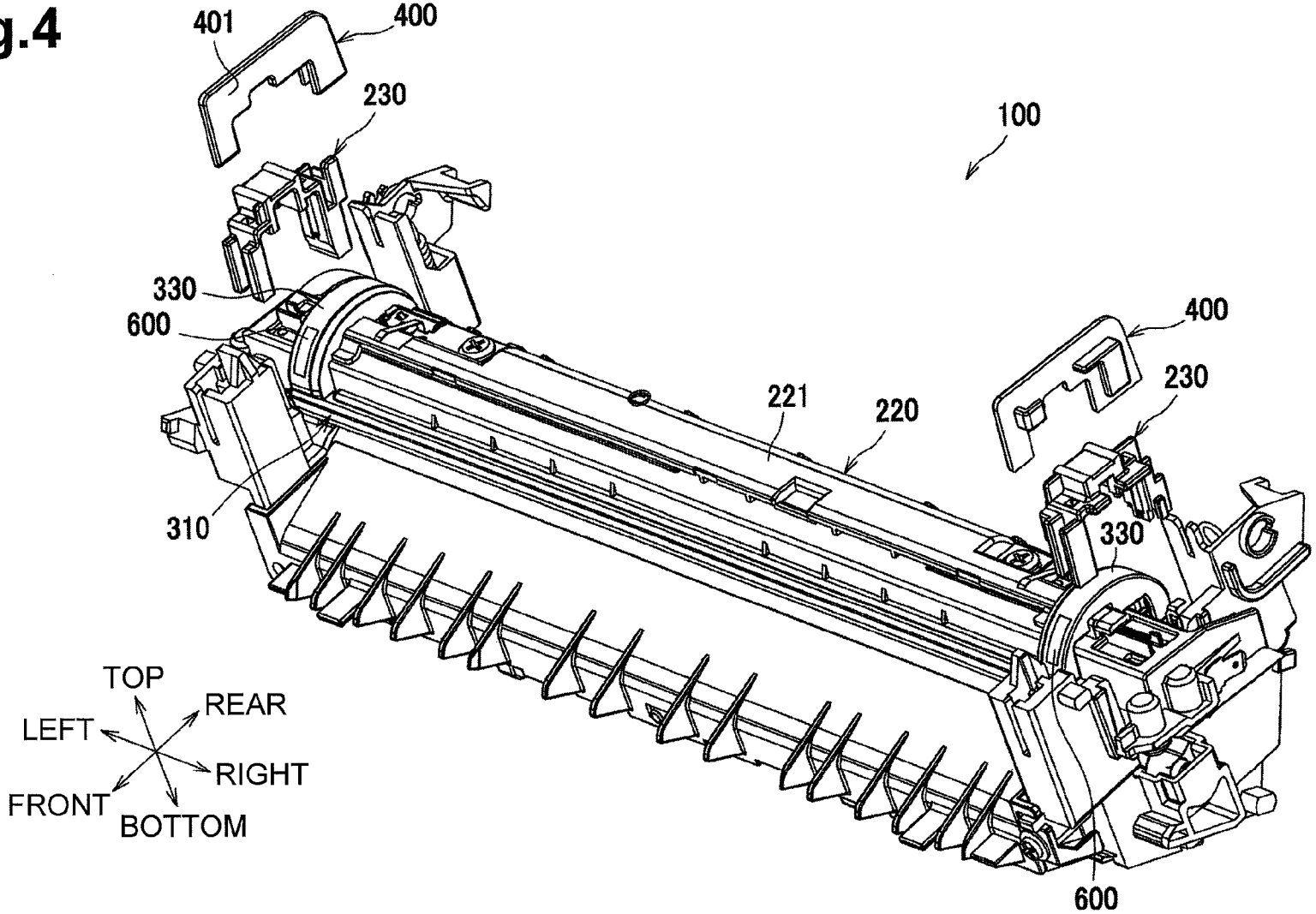
FIG. 4 is an exploded perspective view of the fixing device including restricting members and end portion guides.

The upstream guide 310 is disposed upstream relative to the nip N in a rotation direction of the fixing belt 110 and configured to guide the fixing belt 110 toward the nip N. As illustrated in FIGS. 3 and 4, the upstream guide 310 extends long in the left-right direction. Left and right end restricting members 400 each have a restriction surface 401 to restrict a position of an end of the fixing belt 110. The left and right end restricting members 400 are disposed above left and right end portions of the upstream guide 310 in the left-right direction, respectively.

Left and right end guides 330 are disposed adjacently above the left and right end portions of the upstream guide 310, respectively. The end guides 330 are configured to guide the fixing belt 110 toward the upstream guide 310 by contacting left and right end portions of the inner cylindrical surface of the fixing belt 110. Each of the end guides 330 is spaced apart from the nip N and disposed further to the center in the left-right direction than a corresponding one of the end regulating members 400. Each of the end regulating members 400 is disposed at a corresponding one of left and right end portions of the first covering member 210 via an intermediate member 230.

As illustrated in FIGS. 2 to 4, the second covering member 220 extends long in the left-right direction and is disposed above the first covering member 210 (or on a side thereof opposite to the stay 160) such that it covers a part of the first covering member 210. The second covering member 220 mainly includes an upper wall 221, a rear wall 222 extending downward from a rear end of the upper wall 221, and an extension wall 223 extending rearward from a lower end of the rear wall 222. Left and right end portions of the upper wall 221 are integrally formed with the respective end guides 330 configured to guide an upper portion of the fixing belt 110.

The end guides 330 will be described in detail.

As illustrated in FIGS. 2 and 3, each end guide 330 is an example of an inner surface guide, and has an outer cylindrical surface having an arc-shape in cross section, which functions as a guide surface 331. The end guide 330 is semi-tubular shaped such that substantially an upper half of the inner cylindrical surface of the fixing belt 110 slides on the guide surface 331 of the end guide 330.

Each end guide 330 includes a plane heater 600 as an example of a second heating element configured to generate heat. Each plane heater 600 is disposed in a front portion of a corresponding end guide 300. With this structure, left and right end portions of the fixing belt 110, at which the temperature is less likely to rise by the application of heat from the halogen lamp 120, can be heated by the respective plane heaters 600 while being guided by the respective end guides 330. Thus, the temperatures at the left and right end portions of the fixing belt 110 can be maintained appropriately.

As the plane heaters 600, ceramic heaters or sheet heaters having heating wires may be used.

The front portion of each end guide 300 is provided with a recessed portion 332 which is recessed relative to the guide surface 331 and in which the plane heater 600 is engaged. The plane heater 600 is fixed into the recessed portion 332 by engagement. For example, if the plane heater 600 is glued to the end guide, it is important to select an adhesive, which is resist to heat from the plane heater 600. In the embodiment, however, the plane heater 600 can be fixed to the end guide 330 without the use of an adhesive, there is no need to select a type of adhesive.

The recessed portion 332 has a depth smaller than or equal to the thickness of the plane heater 600. When the plane heater 600 is engaged in the recessed portion 332, an outer surface of the plane heater 600 becomes flush with or slightly protrudes from the guide surface 331, so that the fixing belt 110 can slidably contact the plane heater 600. Thus, each end portion of the fixing belt 110 slidably contacts the corresponding plane heater 600 and can be directly heated by the plane heater 600.

A bottom surface of the recessed portion 332 is arc-shaped in cross section in line with the guide surface 331. When the plane heater 600 is engaged in the recessed portion 332, the outer surface of the plane heater 600 contacting the fixing belt 110 also becomes arc-shaped in cross section and can guide the end portion of the fixing belt 110 smoothly.

The plane heater 600 is disposed upstream relative to the nip N of in the rotation direction (or a moving direction) of the fixing belt 110 by being attached to the recessed portion 332 formed at the front portion of the end guide 330. In other words, the plane heater 600 is disposed closer to an upstream end of the nip N than a downstream thereof in the rotation direction of the fixing belt 110.

A portion of the fixing belt 110 upstream relative to the nip N in the rotation direction becomes under tension by being drawn into the nip N. As a tensed portion of the fixing belt 110 faces the heater 600 disposed upstream relative to the nip N in the rotation direction at substantially a constant distance therebetween, each end portion of the fixing belt 110 can be heated by a corresponding heater 600.

Figure 5:
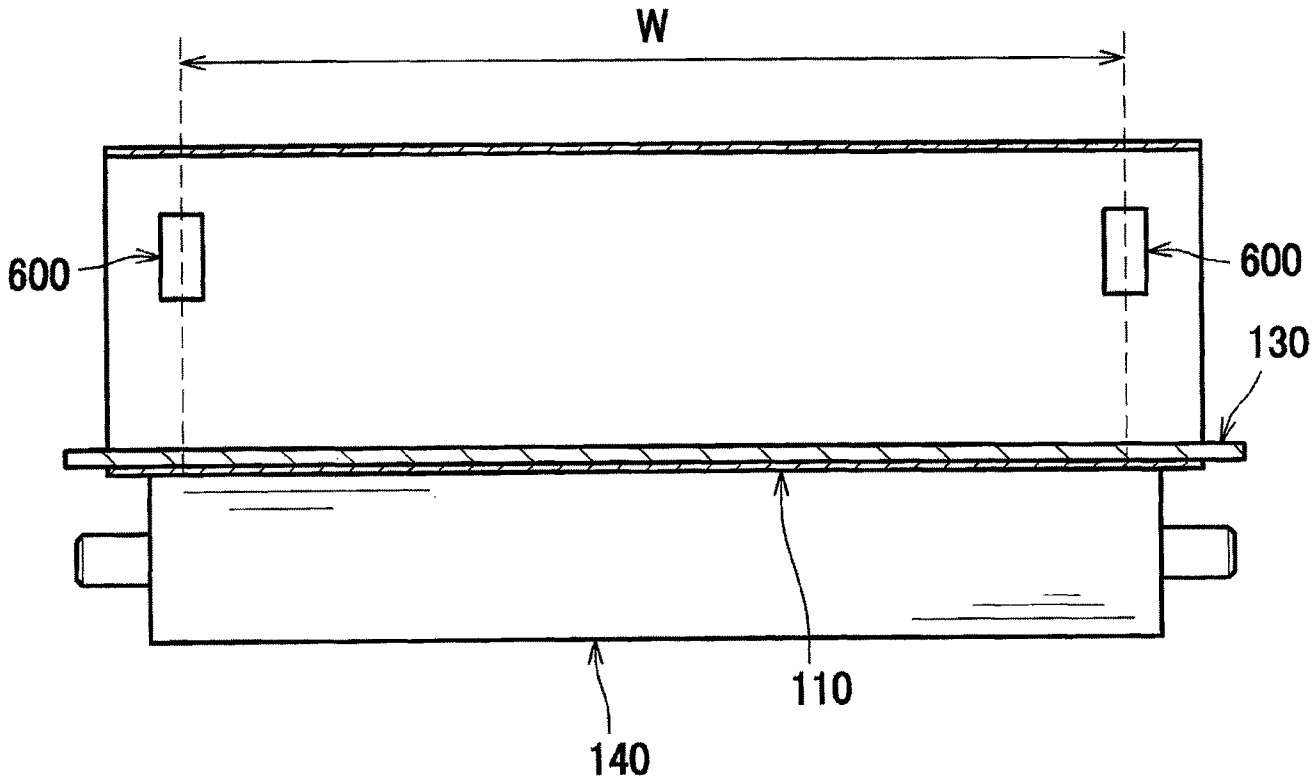
FIG. 5 illustrates positions of plane heaters relative to a sheet having a maximum width.

As illustrated in FIG. 5, a portion of each plane heater 600 is disposed within an area corresponding to a sheet 51 having a maximum width W on which the fixing device 100 is configured to fix an image. Thus, as end portions of the sheet 51 having the maximum width in the width direction can be heated by the respective end portions of the fixing belt 110 heated by the plane heaters 600, the entire of the sheet 51 having the maximum width W can be heated and an image formed thereon can be fixed preferably.

A controller 500 includes a central processing unit or CPU, a random access memory or RAM, a read only memory or ROM, and an input/output circuit. The controller 500 performs control based on programs and data stored in the ROM. Specifically, the controller 500 is configured to set the plane heater 600 to an off state for thermally fixing a sheet 51 having a minimum width on which the fixing device 100 is configured to fix an image. The controller 500 is also configured to set the plane heater 600 to an on state during warm up prior to printing control.

In the embodiment, a sheet 51 is fed such that a center of the sheet 51 in the width direction matches a center of the fixing belt 110 in the width direction.

Figure 6:
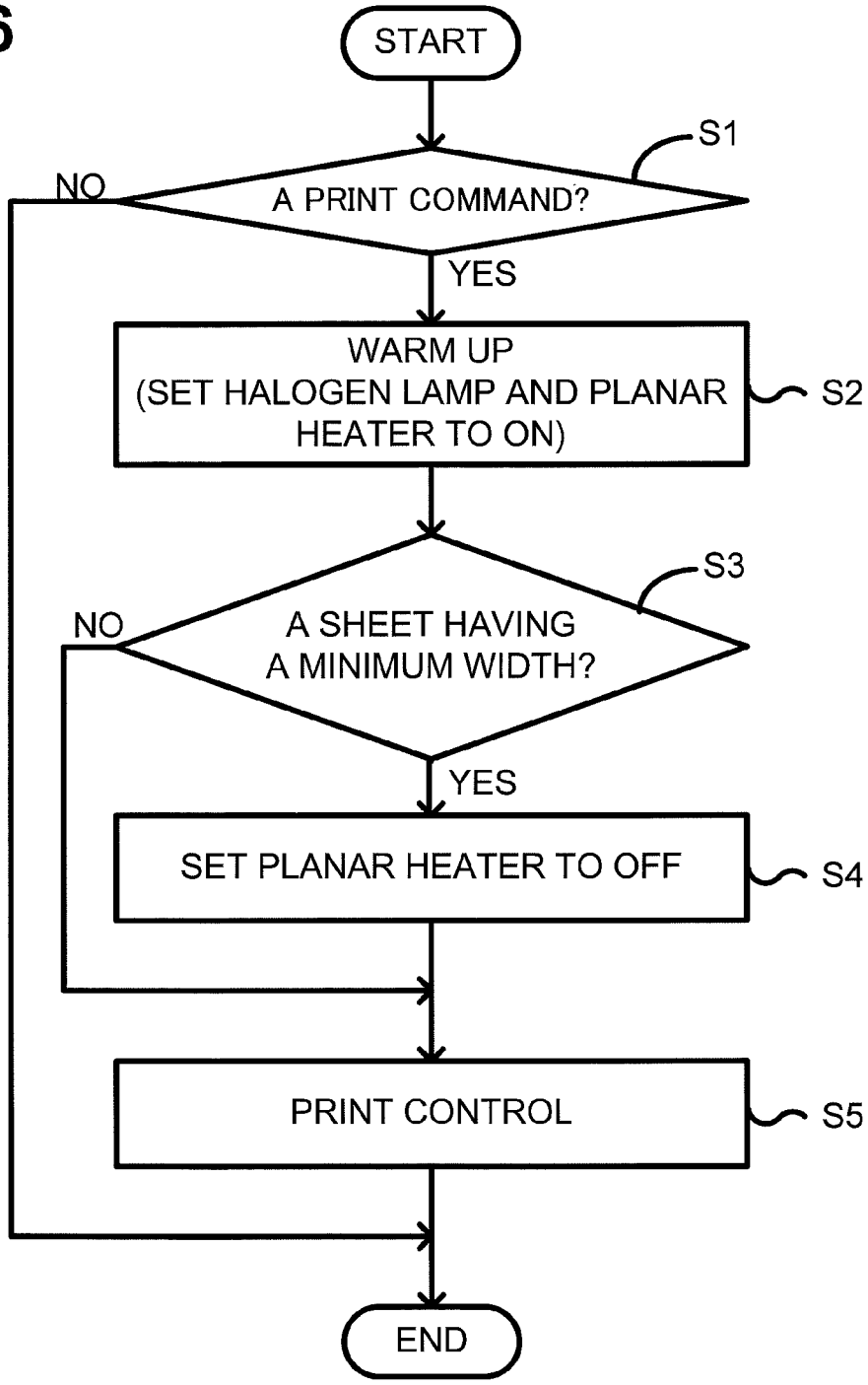
FIG. 6 is a flowchart showing operations of a controller.

Specifically, the controller 500 performs control in accordance with a flowchart illustrated in FIG. 6.

As illustrated in FIG. 6, the controller 500 determines whether there is a print command (S1). When the controller 500 determines that there is a print command at S1 (Yes), it performs warm up operation (S2).

At S2, the controller 500 sets both of the halogen lamp 120 and the plane heaters 600 to the on state, causes the photosensitive drums 31 to rotate, and causes toner to be agitated. As the controller 500 sets the plane heaters 600 to the on state during the warm up, the end portions of the fixing belt 110 can become heated to an appropriate high temperature at the printing control. The nip N can be heated promptly by setting the halogen lamp 120 and the plane heaters 600 to the on state.

After S2, the controller 500 determines whether a sheet 51 to be printed has a minimum width on which the fixing device 100 is configured to fix an image (S3). At S3, when the controller 500 determines that the sheet 51 has the minimum width (Yes), it sets the plane heaters 600 to the off state (S4). This prevents the end portions of the fixing belt 110 that do not contact the sheet 51 from being heated by the plane heaters 600 uselessly when an image on the sheet 51 having the minimum width is thermally fixed. Thus, the end portions of the fixing belt 110 can be prevented from overheating.

After S2, when the controller 500 determines "No" at S3, it performs printing control (S5). After S5 or when the controller 500 determines "No" at S1, it ends the control.

A modification of the disclosure will be described. It is noted that, in the following description, elements similar to or identical those illustrated and described in the above embodiment are designated by similar numerals, and thus the description thereof can be omitted for the sake of brevity.

Figure 7:
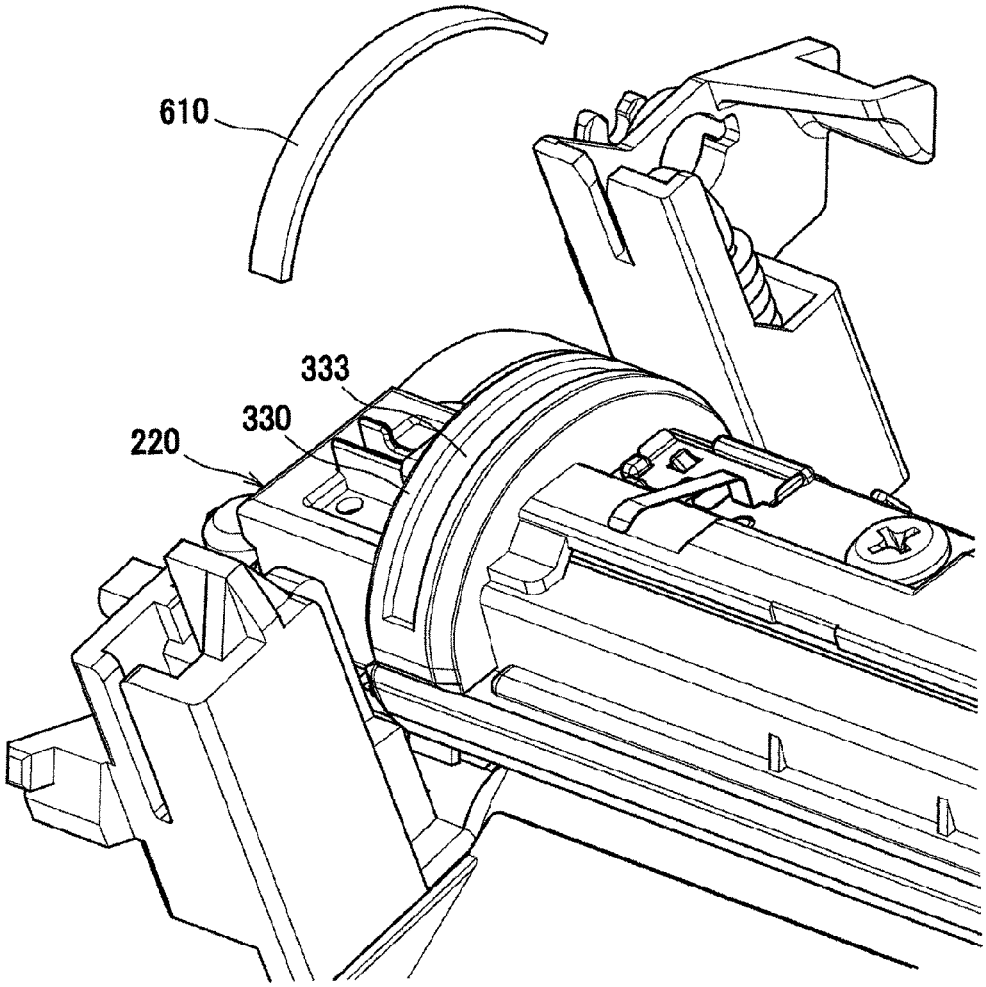
FIG. 7 is an enlarged perspective view of a modified plane heater.

The above embodiment shows, but is not limited to, the plane heaters 600 disposed on the front portions of the respective end guides 300. For example, as illustrated in FIG. 7, a plane heater 610 extending from a front portion of the end guide 330 to a rear portion thereof may be used. In this case, a recessed portion 333 may be formed extending from a front portion of the end guide 330 to a rear portion thereof.

The above embodiment shows, but is not limited to, the plane heaters 600 attached to the respective end guides 330 by being engaged in the respective recessed portions 332. For example, the second heating element may be glued onto or screwed into the inner surface guide. Alternatively, the second heating element may be embedded inside the inner surface guide.

The above embodiment shows, but is not limited to, the end guides 330 as an example of the inner surface guide. For example, the upstream guide 310 or the downstream guide 320 may function as the inner surface guide. In other words, the second heating elements may be disposed on both end portions of the upstream guide 310 or the downstream guides 320.

The above embodiment shows, but is not limited to, that the inner surface guide and the second heating element are different members. The inner surface and the second heating element may be constituted as a single member. For example, a ceramic heater may be formed into an identical shape with the end guide 330 to function as the inner surface guide.

The above embodiment shows, but is not limited to, that a portion of each plane heater 600 is disposed within the area corresponding to a sheet 51 having the maximum width W on which the fixing device 100 is configured to fix an image. The second heating element may be entirely disposed within or outside of the area corresponding to the sheet having the maximum width.

The above embodiment shows, but is not limited to, the pressure roller 140 as an example of a backup member. The backup member may include, for example, a belt-like pressing member.

The above embodiment shows, but is not limited to, the nip plate 130 as an example of the nip member. The nip member may comprise, for example, a thick member that might not have a plate-like shape.

The above embodiment shows, but is not limited to, the color laser printer 1 to which the disclosure is applied. The disclosure may be applied to other image forming apparatuses, such as, a copier and a multifunction apparatus.

The above embodiment shows, but is not limited to, the halogen lamp 120 as an example of the first heating element. The heating element may include a carbon heater.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A fixing device comprising:

an endless belt extending in a first direction and configured to rotate;

a nip member extending in the first direction and disposed in contact with an inner surface of the endless belt;

a backup member extending in the first direction and disposed in contact with an outer surface of the endless belt such that the backup member and the nip member sandwich the endless belt therebetween and the backup member and the endless belt form a nip therebetween;

a first heating element extending along the endless belt in the first direction and configured to generate heat; and an inner surface guide disposed in contact with an end portion of the inner surface of the endless belt in the first direction and spaced apart from the nip in a second direction perpendicular to the first direction, wherein the inner surface guide includes a second heating element configured to generate heat, and wherein the second heating element is disposed upstream of the nip in a rotation direction of the endless belt.

2. A fixing device comprising:

an endless belt extending in a first direction and configured to rotate;

a nip member extending in the first direction and disposed in contact with an inner surface of the endless belt;

a backup member extending in the first direction and disposed in contact with an outer surface of the endless belt such that the backup member and the nip member sandwich the endless belt therebetween and the backup member and the endless belt form a nip therebetween;

a first heating element extending along the endless belt in the first direction and configured to generate heat; and an inner surface guide disposed in contact with an end portion of the inner surface of the endless belt in the first direction and spaced apart from the nip in a second direction perpendicular to the first direction, wherein the inner surface guide includes a second heating element configured to generate heat, and wherein the second heating element is disposed downstream of the nip in a rotation direction of the endless belt.

3. A fixing device comprising:

an endless belt extending in a first direction and configured to rotate;

a nip member extending in the first direction and disposed in contact with an inner surface of the endless belt;

a backup member extending in the first direction and disposed in contact with an outer surface of the endless belt such that the backup member and the nip member sandwich the endless belt therebetween and the backup member and the endless belt form a nip therebetween;

a first heating element extending along the endless belt in the first direction and configured to generate heat; and an inner surface guide disposed in contact with an end portion of the inner surface of the endless belt in the first direction and spaced apart from the nip in a second direction perpendicular to the first direction, wherein the inner surface guide includes a second heating element configured to generate heat, and wherein the second heating element includes an upstream portion disposed upstream of the nip in a rotation direction of the endless belt and a downstream portion disposed downstream of the nip in the rotation direction of the endless belt.

4. The fixing device according to claim 3, wherein the second heating element extends from the upstream portion to the downstream portion.

5. A fixing device comprising:

an endless belt extending in a first direction and configured to rotate;

a nip member extending in the first direction and disposed in contact with an inner surface of the endless belt;

a backup member extending in the first direction and disposed in contact with an outer surface of the endless belt such that the backup member and the nip member sandwich the endless belt therebetween and the backup member and the endless belt form a nip therebetween;

a first heating element extending along the endless belt in the first direction and configured to generate heat; and an inner surface guide disposed in contact with an end portion of the inner surface of the endless belt in the first direction and spaced apart from the nip in a second direction perpendicular to the first direction, wherein the inner surface guide includes a second heating element configured to generate heat, and wherein the second heating element has a surface in contact with the end portion of the endless belt and the surface of the second heating element is substantially arc-shaped in cross section.

6. The fixing device according to claim 1, wherein the inner surface guide has a recessed portion in which the second heating element is disposed.

7. The fixing device according to claim 1, wherein at least a portion of the second heating element is disposed within an area corresponding to a sheet having a maximum width on which the fixing device is configured to form an image.

8. The fixing device according to claim 1, wherein the first heating element is disposed inside the endless belt.

9. The fixing device according to claim 2, wherein the inner surface guide has a recessed portion in which the second heating element is disposed.

10. The fixing device according to claim 2, wherein at least a portion of the second heating element is disposed within an area corresponding to a sheet having a maximum width on which the fixing device is configured to form an image.

11. The fixing device according to claim 2, wherein the first heating element is disposed inside the endless belt.

12. The fixing device according to claim 3, wherein the inner surface guide has a recessed portion in which the second heating element is disposed.

13. The fixing device according to claim 3, wherein at least a portion of the second heating element is disposed within an area corresponding to a sheet having a maximum width on which the fixing device is configured to form an image.

14. The fixing device according to claim 3, wherein the first heating element is disposed inside the endless belt.

15. The fixing device according to claim 5, wherein the inner surface guide has a recessed portion in which the second heating element is disposed.

16. The fixing device according to claim 5, wherein at least a portion of the second heating element is disposed within an area corresponding to a sheet having a maximum width on which the fixing device is configured to form an image.

17. The fixing device according to claim 5, wherein the first heating element is disposed inside the endless belt.

* * * * *